US009528308B2

(12) United States Patent
Cho et al.

(10) Patent No.: US 9,528,308 B2
(45) Date of Patent: Dec. 27, 2016

(54) MULTI-AXIS HINGE WITH GEARED CONNECTIONS

(71) Applicants: SENEKA CO., LTD., Suwon-si (KR); SHIN ZU SHING CO., LTD., New Taipei (TW)

(72) Inventors: Pil Je Cho, Suwon-si (KR); Young Woo Huh, Suwon-si (KR)

(73) Assignees: Seneka Co., Ltd., Suwon-si (KR); Shin Zu Shing Co., Ltd., New Taipei (TW)

( * ) Notice: Subject to any disclaimer, the term of this patent is extended or adjusted under 35 U.S.C. 154(b) by 0 days.

(21) Appl. No.: 14/196,139

(22) Filed: Mar. 4, 2014

(65) Prior Publication Data

US 2014/0245569 A1 Sep. 4, 2014

(30) Foreign Application Priority Data

Mar. 4, 2013 (KR) ..... 10-2013-0022747

(51) Int. Cl.
*E05D 3/12* (2006.01)

(52) U.S. Cl.
CPC ..... *E05D 3/122* (2013.01); *Y10T 16/5476* (2015.01)

(58) Field of Classification Search
CPC ..... E05D 3/122; E05D 3/06; E05D 3/12; E05D 3/14; E05D 3/16
See application file for complete search history.

(56) References Cited

U.S. PATENT DOCUMENTS

| | | | | |
|---|---|---|---|---|
| 4,752,105 | A * | 6/1988 | Barnard | B62D 55/08 152/175 |
| 6,223,393 | B1 * | 5/2001 | Knopf | 16/366 |
| 7,251,323 | B2 * | 7/2007 | Holtorf | B32B 3/04 379/433.13 |
| 8,720,011 | B1 * | 5/2014 | Hsu et al. | 16/368 |
| 2010/0180404 | A1 * | 7/2010 | Chang | 16/387 |
| 2010/0232100 | A1 * | 9/2010 | Fukuma et al. | 361/679.01 |
| 2011/0000136 | A1 * | 1/2011 | Brun | 49/358 |
| 2011/0097138 | A1 * | 4/2011 | Eikelenboom | 403/81 |
| 2014/0174226 | A1 * | 6/2014 | Hsu et al. | 74/98 |
| 2014/0174227 | A1 * | 6/2014 | Hsu et al. | 74/98 |

* cited by examiner

*Primary Examiner* — Emily Morgan

(57) ABSTRACT

The hinge device according to the present invention includes a plurality of shaft units arranged in parallel, and a link unit configured to connect each shaft unit and rotate about each shaft unit, wherein rotation of a first member and a second member, the first member and the second member being objects of hinge, is realized by rotation of each link unit using a plurality of rotation shaft as a base.

8 Claims, 9 Drawing Sheets

MULTI-AXIS HINGE WITH GEARED CONNECTIONS

CROSS-REFERENCE TO RELATED APPLICATIONS

This application claims priority to Korean Patent Application No. 10-2013-0022747, filed on Mar. 4, 2013, and all the benefits accruing therefrom under 35 U.S.C. §119, the contents of which in its entirety are herein incorporated by reference.

TECHNICAL FIELD

The present invention relates to a hinge device configured to be a hinged support between two structures.

BACKGROUND OF THE INVENTION

A hinge is used for rotating two structures. There is needed a hinge for rotating structures using a new method in consideration of design aspect and user convenience.

One example of the hinges describing prevention of accidents is disclosed in Korean Patent Laid-Open Publication No. 10-2009-0132073, in which a door is automatically braked the moment the door is closed to prevent a finger or a toe from being caught in a door crevice. However, the Korean Patent Laid-Open Publication describes a traditional hinge structure that rotates each structure about a single axial part.

PRIOR ART

Patent Document

Korean Patent Laid-Open Publication No. 10-2009-0132073

DISCLOSURE OF INVENTION

Technical Field

The present invention relates to provide a hinge device configured to rotate each structure using a new method.

It should be emphasized, however, that the present invention is not limited to a particular disclosure as explained above. It should be understood that other technical subjects not mentioned herein may be appreciated by those skilled in the art.

Technical Solution

In one general aspect of the present invention, there is provided a hinge device, the hinge device comprising:

a plurality of shaft units arranged in parallel; and a link unit configured to connect each shaft unit and rotate about each shaft unit.

In another general aspect of the present invention, there is provided a hinge device, comprising:

a shaft unit extended to a first direction; and a link unit mounted in parallel with a plurality of shaft units, wherein a plural number of the link units is arranged in parallel along a second direction, and the one shaft unit is mounted with a plurality of the link units at a position different from the first direction.

In still another general aspect of the present invention, there is provided a hinge device, comprising:

a plurality of shaft units arranged in parallel; and a link unit configured to connect the two shaft units, wherein the three shaft units are connected by the two link units.

In further general aspect of the present invention, there is provided a hinge device, comprising:

a first link unit and a second link unit mounted with a plurality of shaft units along an extended direction and mounted along with a particular shaft unit among the shaft units, wherein the extended direction of the first link unit and an extended direction of the second link unit are mutually different.

In still further general aspect of the present invention, there is provided a hinge device, comprising:

a plurality of shaft units between a first member and a second member, the first and second members being objects of hinge, wherein a part of the shaft units is not restricted by the first and second members.

In still further general aspect of the present invention, there is provided a hinge device, comprising:

a body unit formed with a through hole inserted by a shaft unit extended to a first direction, wherein a plurality of the through holes is formed along a second direction.

Advantageous Effect of the Invention

The hinge device according to the present invention includes a plurality of shaft units and a plurality of link units, and rotation of a first member and a second member, the first member and the second member being objects of hinge, may be realized through rotation of each link unit using a plurality of rotation shaft as a base, whereby a variety of degrees of freedom can be provided including a degree of freedom capable of positioning the first member and the second member on a straight line, and an elegant external beauty can be provided as well.

Furthermore, a cross-section of a link unit may be formed with a gear unit to allow a plurality of link units connected to a plurality of rotation shaft to rotate at a same angle.

DETAILED DESCRIPTION OF THE INVENTION

Figure 1:
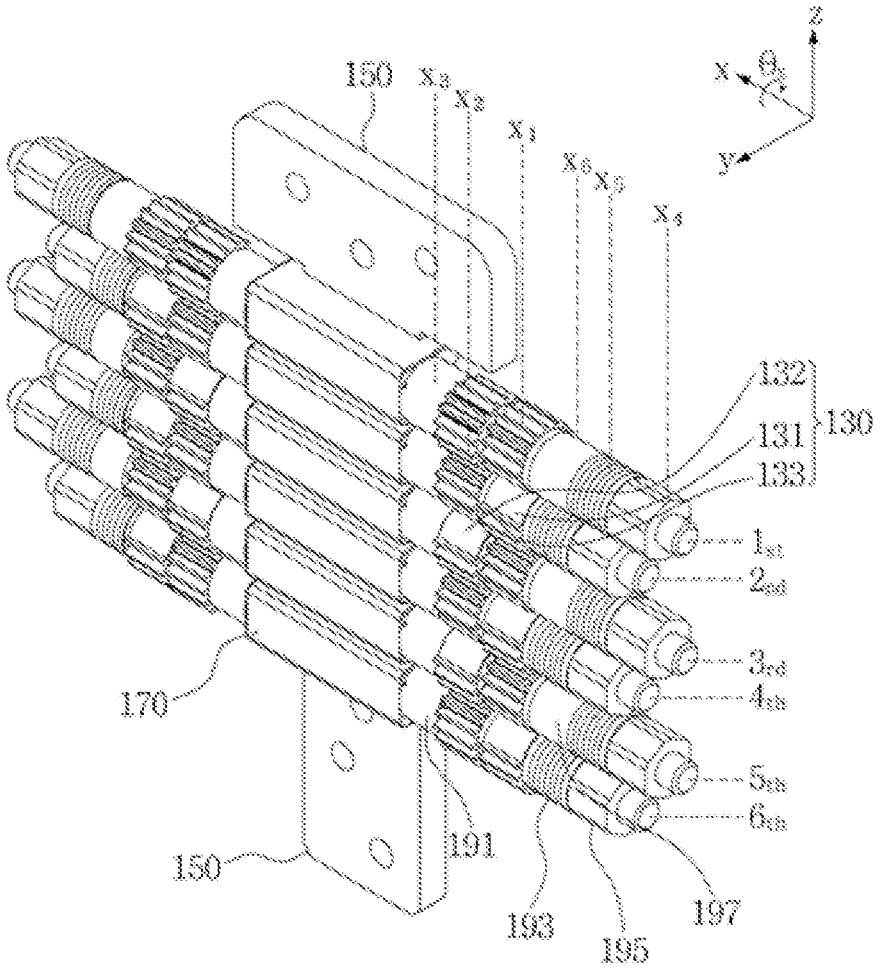
FIG. 1 is a schematic view of a hinge device according to the present invention.

Now, exemplary embodiments of the present invention will be described in detail with reference to the accompanying drawings.

In the drawings describing the present invention, the size and relative sizes of layers, regions and/or other elements may be exaggerated or reduced for clarity and convenience. Accordingly, the meaning of specific terms or words used in the specification and claims should not be limited to the literal or commonly employed sense, but should be construed or may be different in accordance with the intention of a user or an operator and customary usages. Therefore, the definition of the specific terms or words should be based on the contents across the specification.

FIG. 1 is a schematic view of a hinge device according to the present invention. Referring to FIG. 1, a hinge device (100) may include a plurality of shaft units (110) arranged in parallel, and a link unit (130) configured to connect each shaft unit (110).

The hinge device according to the present invention may be a support, which is a rotation center between a first member (210) and a second member (220). The first member (210) may be a wall, a body of a mobile terminal and a body of a notebook. The second member (220) may be a door corresponding to a wall, a display unit corresponding to a body of a mobile terminal, and a display unit corresponding to a body of a notebook.

The shaft unit (110) may be an element functioning as a rotation shaft, and the hinge device according to the present invention may be a plurality of shaft units (110) arranged in parallel as illustrated in FIG. 1.

One of the shaft units in the two shaft units arranged at an extreme external side while the plurality of shaft units (110) is arranged in parallel may be mounted on the first member (210), and the other shaft unit may be mounted at the second member (220). According to this configuration, a plurality of shaft units (110) may be arranged in parallel between the first member (210) and the second member (220), which are objects of a hinge, and a part of the shaft units (110) may not be restricted by the first member (210) and the second member (220). According to this configuration, a variety of degrees of freedom may be provided to the first member (210) and the second member (220), because the shaft unit (110) in the plurality of shaft units (110) not mounted on the first member (210) and the second member (220) is present.

The link unit (130) may be used as a means for connecting each shaft unit (110) while the plurality of shaft units (110) is arranged in parallel.

The link unit (130) may connect each shaft unit (110), and may be rotated about each shaft unit (110).

If the plurality of shaft units (110) is connected by one single link unit (130), rotation about each shaft unit (110) is impossible. In order to allow the link unit (130) to rotate about each shaft unit (110), there is a need to provide the link unit (130) connecting two or more shaft units (110) in a plural number. For example, when one link unit (130) connects a first shaft unit and a second shaft unit, another link unit (130) may connect a second shaft unit and a third shaft unit. When the shaft units (110) are connected by this method, each link unit (130) may be rotated about each shaft unit (110), and at the same time, the number of shaft units (110) and the number of link units (130) may be increased to a desired level.

At least a part of particular shaft units, e.g., the second shaft unit, may be connected to at least two link units (130). At this time, there is a need of excluding interference between each link unit (130). To this end, each shaft unit (110) may be mounted with a plurality of link units (130), each at a mutually different position, to a lengthwise direction of the shaft unit (110).

For example, as illustrated in FIG. 1, the second shaft unit ($2^{nd}$) is connected to two link units (130). One of the two link units (130) may be connected to a position ($x_1$) near to a distal end at the right side, and the other link unit (130) may be connected to a position ($x_2$) near to a distal end at the left side. According to this configuration, each link unit (130) may maintain a state in which mutual movement is not interfered. Furthermore, each link unit (130) may rotate about the second shaft unit ($2^{nd}$) as a center shaft. A separate member may be interposed between each link unit (130), or as illustrated in FIG. 1, the each link unit (130) may be mounted, each contacting the other, with no separate member interposed between each link unit.

The link unit (130) may be mounted with a plurality of shaft units (110) in parallel. In order for the plurality of shaft units to be arranged in parallel when the shaft unit (110) in FIG. 1 is extended to a first direction (x axis in the drawing), the link unit (130) must be also mounted in parallel along with the plurality of shaft units. At this time, the parallel is where each shaft unit (110) extended to the first direction may be arranged along a second direction (z axis in the drawing) in mutually parallel state. For information, the first direction and the second direction may be mutually in a vertical relationship. At this time, the second direction may be a direction under a state where the degree of rotational freedom with the first direction as an axis is not considered.

The link unit (130) may be arranged in plural number along the second direction. At this time, one shaft unit (110) may be mounted with a plurality of link units (130) at mutually different positions ($x_1$, $x_2$) of the first direction as in the second shaft unit ($2^{nd}$).

In the drawing, two shaft units (110) are connected by one link unit (130), and three shaft units (110) are connected by two link units (130). To this end, one of the three shaft units (110) must be connected to two link units (130).

For example, it is presumed that the three shaft units (110) are respectively a first shaft unit, a second shaft unit and a third shaft unit, and two link units are respectively a first link unit (131) and a second link unit (132). At this time, the first link unit (131) may connect the first shaft unit and the second shaft unit, and the second link unit (132) may connect the second shaft unit and the third shaft unit. According to this configuration, the parallel arranged plural shaft units (110) may be connected in not mutually-distanced manner using the link unit (130) to guarantee the free rotation of the link unit (130). A mounted position of the first link unit (131) connected to the second shaft unit and a mounted position of the second link unit (132) may be different, whereby the link unit (130) may be arranged in a plural manner relative to the plurally-arranged shaft units (110).

A first row may be arranged with the first link unit (131), and a second row may be arranged with the second link unit. An x axis position of the first row may be $x_1$, and an x axis position of the second row may be $x_2$.

The first link unit (131) and the second link unit (132) may be mounted with a plurality of shaft units (110) along an extended direction. Furthermore, both the first link unit (131) and the second link unit (132) may be mounted at a particular shaft unit among the plurality of shaft units (110). At this time, an extended direction of the first link unit (131) and an extended direction of the second link unit (132) may be mutually different.

Because the extended direction of the first link unit (131) and the extended direction of the second link unit (132) are mutually different, a shaft unit connected to the first link unit (131) and a shaft unit connected to the second link unit (132) may be mutually different except for the particular shaft unit. A mounted position of the first link unit (131) and a mounted position of the second link unit (132) may be mutually different to a lengthwise direction of the particular shaft. In above exemplary embodiment, the particular shaft unit is a second shaft unit, another shaft unit connected to the first link unit (131) is the first shaft unit, and still another shaft unit connected to the second link unit (132) is a third shaft unit.

The first link unit (131) and the second link unit (132) may be arranged in plural number to a direction perpendicular to a lengthwise direction of the shaft unit (110). At this time, the direction perpendicular to the lengthwise direction of the shaft unit (110) may be a second direction (z axis direction in the drawing). At this time, a distal end of the first link unit (131) may be formed with a gear unit (133) meshed with the adjacent first link unit (131), and a distal end of the second link unit (132) may be formed with a gear unit (133) meshed with the adjacent second link unit (132). Each link unit (130) that is not formed with the gear unit (133) at the first link unit (131) and the second link unit (132) may freely rotate using each shaft unit (110) as a rotation shaft. For example, the first link unit (131) connected to the second shaft unit ($2^{nd}$) and the second link unit (132) may rotate at 15° and the first link unit (131) connected to a fifth link (130, $5^{th}$) and the second link unit (132) may rotate at 30°. In order for a rotational angle of the link unit (130) using each shaft unit (110) as a rotation shaft to be same, the gear unit (133) formed at the distal end of each link unit (130) may be used. At this time, an operation of each link unit (130) rotating in the same manner through the gear unit (133) is illustrated in FIG. 5.

Figure 5:
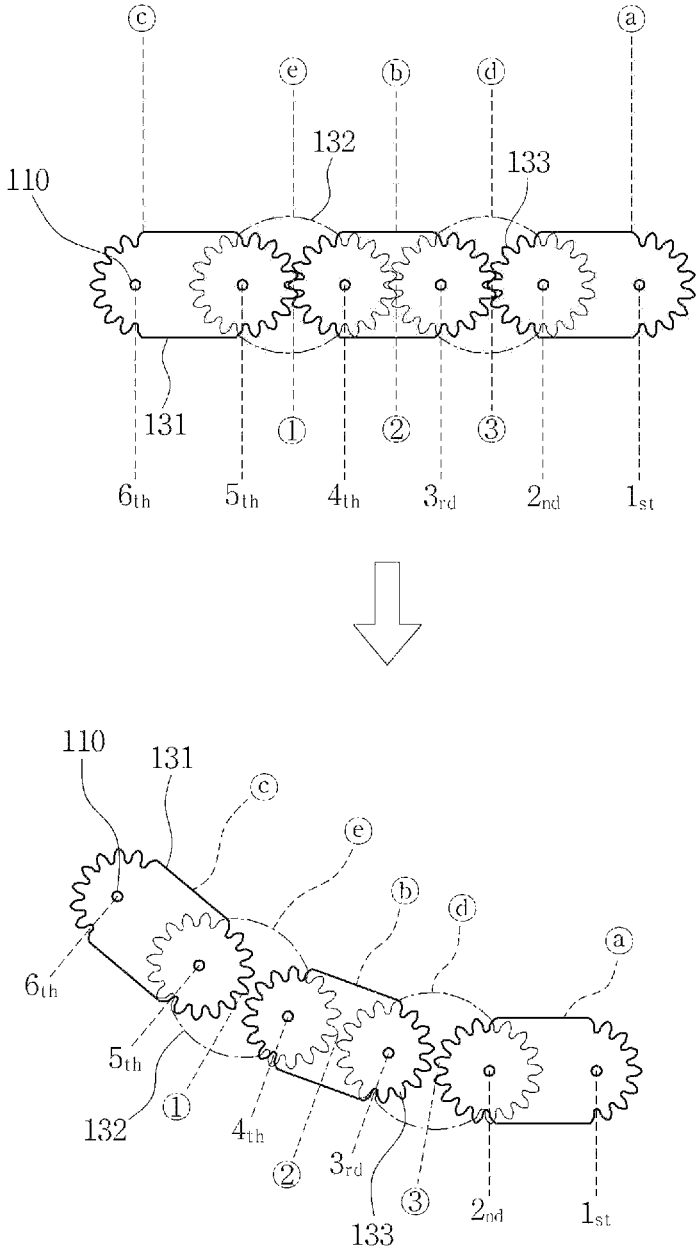
FIG. 5 is a schematic view illustrating operation of a hinge device according to the present invention.

FIG. 5 is a schematic view illustrating operation of a hinge device according to the present invention.

The hinge device illustrated in FIG. 5 is provided with six shaft units (1st to $6^{th}$), five link units {130, *a* to *e*}, a part ① meshed with gear units (133) each formed with link units {130, *b* and *c*}, a part ② meshed with gear units (133) each at the link unit {130, *d* and *e*}, and a part ③ meshed with gear units (133) each formed at the link unit {130, *a* and *b*}.

Although FIG. 5 differently shows the thickness of ⓐ, ⓑ, ⓒ corresponding to the first link unit (131) and the thickness of ⓓ, ⓔ corresponding to the second link unit, it is just for convenience sake, and the thickness of the first link unit (131) and the thickness of the second link unit (132) may be same.

When a force of an arrow direction is applied to the first link (131) *c*, the first link unit (131) *c* rotates to the arrow direction about the shaft unit (110) 5th. Thereafter, the second link unit (132) *e* rotates to the arrow direction about the shaft unit (110) 4th due to operation of each gear unit (133) of part ①. Then, the first link unit (131) *b* rotates to the arrow direction about the shaft unit (110) $3^{rd}$ due to operation of each gear unit (133) of part ②. Thereafter, the second link unit (132) *d* rotates to the arrow direction about the shaft unit (110) $2^{nd}$ due to operation of each gear unit of part ③. As a result, an angle of each link unit (130) rotating about the particular shaft unit is same. Of course, to this end, there is a need of each length and gap of each gear unit (133) forming each part ① and ③ to be same.

Although the aforementioned description has illustrated each operation of each link unit (130) and each gear unit (133) in a time-sequential manner, each operation may be simultaneously realized. This is because the force may be actually applied to the entire element, even if the force is applied to the arrow direction in FIG. 5.

Figure 6:
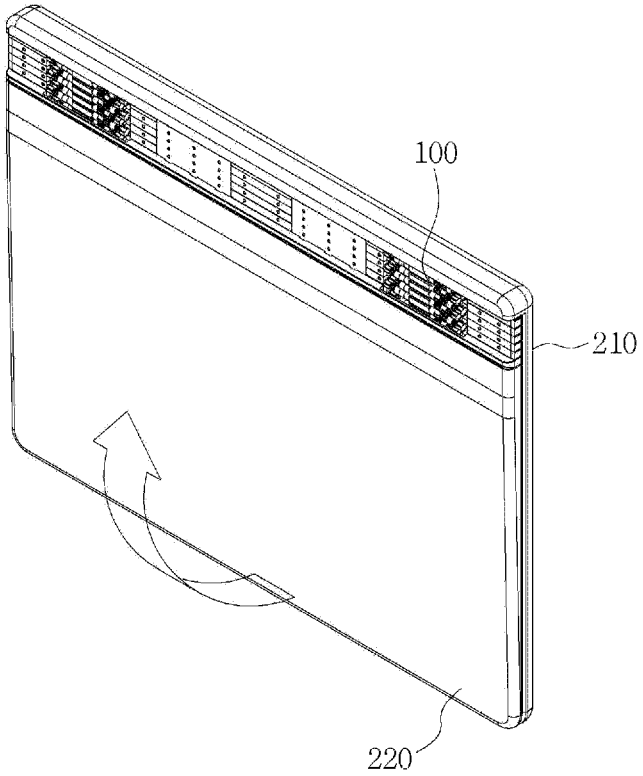
FIG. 6 is a schematic view illustrating a state where a first member and a second member supported by a hinge device according to the present invention are closed.
Figure 7:
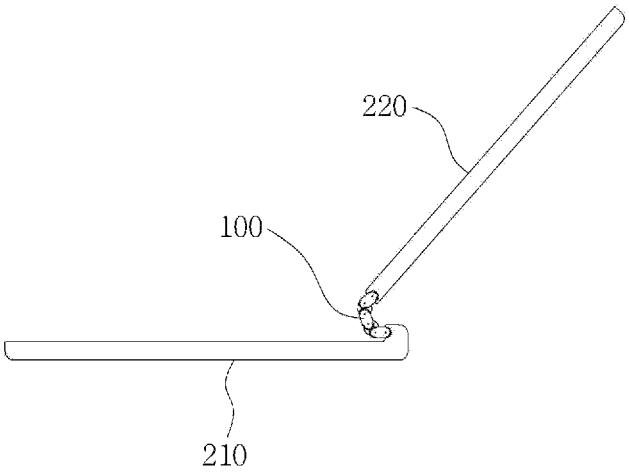
FIG. 7 is a schematic view illustrating a state where a first member and a second member supported by a hinge device according to the present invention are opened.

FIG. 6 is a schematic view illustrating a state where a first member (210) and a second member (220) supported by a hinge device according to the present invention are closed, and FIG. 7 is a schematic view illustrating a state where a first member (210) and a second member (220) supported by a hinge device according to the present invention are opened.

FIG. 6 illustrates a state before an external force is applied to the hinge device (100) as in the left drawing of FIG. 5. The hinge device (100) is unfolded to a second direction, whereby the first member (210, a body of a notebook), and the second member (220, a display unit of the notebook) become closed. Under this state, when a user holds the second member (220) while the first member (210) is fixed, a force is applied to the hinge device toward an arrow direction.

The hinge device is bent by the application of force as in the right drawing of FIG. 5, whereby the first member (210) and the second member (220) are in an opened state as in FIG. 7.

An opened angle between the first member (210) and the second member (220) may be determined by which method the hinge device is attached to the first member (210) and the second member (220). For example, the first member (210) and the second member (220) may spread at an angle of 180°, as shown in FIG. 9 depending on a mounted position of the hinge device.

Figure 8:
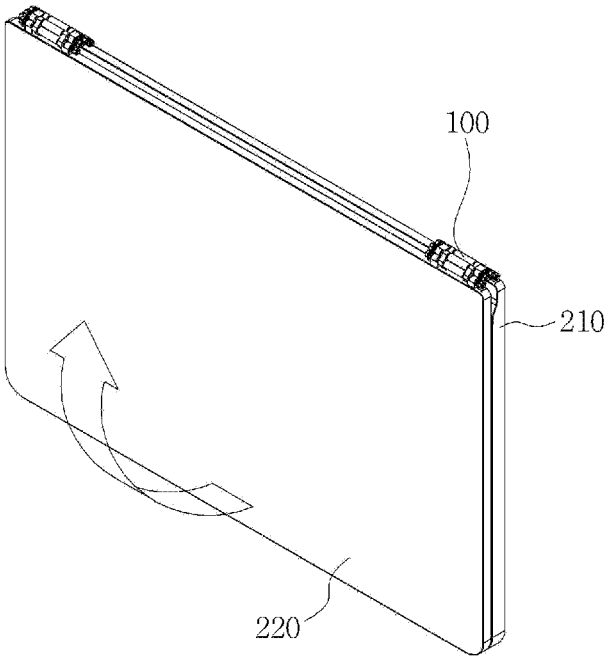
FIG. 8 is a schematic view illustrating a state where another first member and another second member supported by a hinge device according to the present invention are closed.
Figure 9:
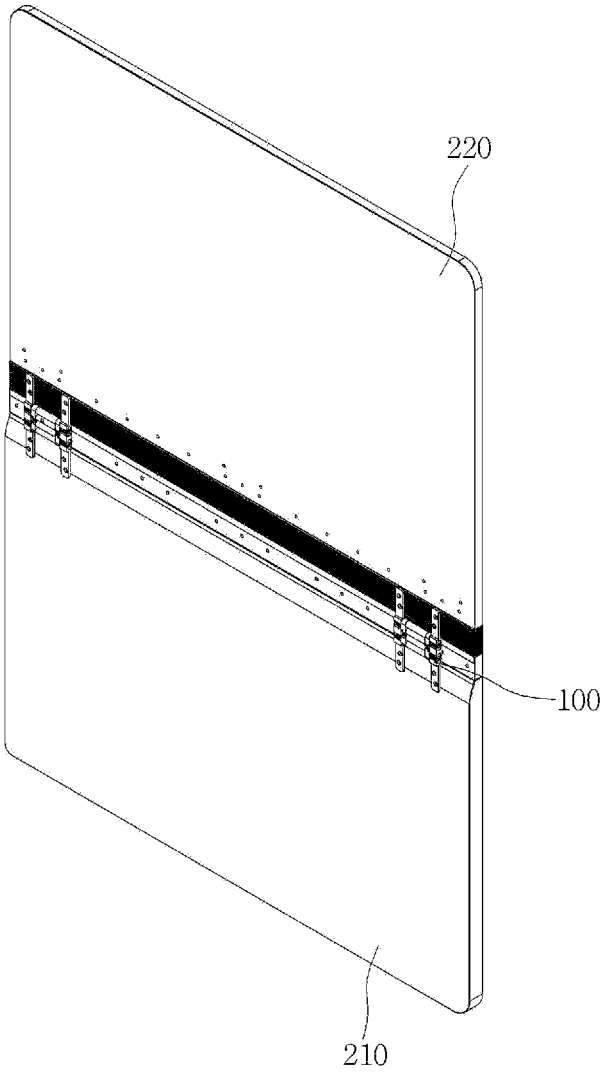
FIG. 9 is a schematic view illustrating a state where another first member and another second member supported by a hinge device according to the present invention are opened.

FIG. 8 is a schematic view illustrating a state where another first member (210) and another second member (220) supported by a hinge device according to the present invention are closed, and FIG. 9 is a schematic view illustrating a state where another first member (210) and another second member (220) supported by a hinge device according to the present invention are opened.

Referring to FIG. 8, a lateral surface of the first member (210) and a lateral surface of the second member (220) are fastened by the hinge device. According to this configuration, when a force is applied to an arrow direction of FIG. 8, the first member (210) and the second member (220) may be unfolded at a 180° gap, as shown in FIG. 9.

Meantime, as illustrated in FIG. 9, even if the first member (210) and the second member (220) are unfolded to a limited angle of 180°, the user may desire to unfold the first member (210) and the second member (220) at an intermediate angle of 120°.

To this end, it is preferable that the hinge device be moved by a force applied by a user, and the hinge device not be moved by gravitational force. To this end, the hinge device needs to be restricted by an adequate force.

Referring back to FIG. 1, the shaft unit (110) may be mounted with the first link unit (131) at a first position ($x_1$) to a lengthwise direction, the second link unit (132) may be mounted at a second position ($x_2$), a support (191) may be mounted at a third position ($x_3$), and a pressure unit (195) may be mounted at a fourth position ($x_4$) that presses the first link unit (131) and the second link unit (132) to a direction facing the support (191). As a result, each link unit (130) is applied with a pressure to a lengthwise direction of the shaft unit (110) which is a rotation shaft of each link unit (130).

In order to apply a pressure to the first link unit (131) and the second link unit (132), at least a fixed point is needed that is not moved to a lengthwise direction of the shaft unit (110). The support (191) is used for the fixed point. The support (191) may be variably configured within a scope that satisfies the fixed point. For example, when a protruding lug is formed at a distal end of the shaft unit (110) or at a middle section of the shaft unit (110), the lug may become the support (191). In another example, when the shaft unit (110) is inserted by a ring, and a pressure is applied from both distal ends of the shaft unit (110), a ring position may be fixed to a lengthwise direction of the shaft unit (110), where the ring becomes the support (191).

FIG. 1 illustrates a case where a lug radially protruded from the shaft unit (110) is the support (191) at an approximate center of the shaft unit. In this case, the support (191), the second link unit (132), the first link unit (131) and the pressure unit (195) may be mounted from the center of the shaft unit (110) toward a distal end of the shaft unit (110).

The movement of the shaft unit (110) may be fixed, if the pressure by the pressure unit (195) is strong and even if pressure is applied to a lengthwise direction of the shaft unit (110). As a preventive measure, an elastic unit (193) may be interposed between the support (191) and the pressure unit (195). In the drawing, a plurality of Belleville springs is mounted at a fifth position ($x_5$) as the elastic unit (193).

The pressure unit (195) may use a bolt configuration to maintain a reliable pressure. A screw thread corresponding thereto may be formed at a fourth position ($x_4$) of the shaft unit (110). In order to apply pressure using the pressure unit (195) with the bolt configuration, the pressure unit (195) needs to be rotated, where, if mounted positions ($x_4$) of the bolts are same, it may be difficult to tighten the pressure unit (195) due to interference between the adjacent bolts. As a measure to cope with the problem, the mutually adjacent two shaft units (110) may be different in the fourth position ($x_4$).

To this end, the lengths of the adjacent two shaft units (110) may be differently arranged, or a separate extension unit (197) may be utilized. FIG. 1 illustrates that two shaft units (110), each having a different length, are repeatedly arranged to a second direction. Furthermore, the longer shaft unit (110) is mounted at a sixth position ($x_6$) with an extension unit (197) having a set length to a first direction. The sixth position ($x_6$) may be positioned between the support (191) and the pressure unit (195), whereby the pressure unit (195) may be arranged so called in a zigzag manner when viewed from a y axis direction.

On the whole, the third position ($x_3$), the second position ($x_2$), the first position ($x_1$), the sixth position ($x_6$), the fifth position ($x_5$) and the fourth position ($x_4$) may be formed from the center of the shaft unit (110) to a direction facing the distal end of the shaft unit (110).

A fastening unit (150) coupled to an object of the hinge device may be formed at the third link unit (130) arranged at a first and an end of the second direction among the link units (130), and at the shaft unit (110) arranged at a first and an end of the second direction. The shaft unit (110) arranged at the first g and the end of the second direction in the drawing may be the first shaft unit ($1^{st}$) and the sixth shaft unit ($6^{th}$), and the fastening unit (150) may be formed at each of the first shaft unit ($1^{st}$) and the sixth shaft unit ($6^{th}$). The fastening unit (150) formed at the first shaft unit ($1^{st}$) may be coupled the first member (210), e.g. a body of a notebook, one of objects of the hinge device, and the fastening unit (150) formed at the sixth shaft unit ($6^{th}$) may be coupled to a sixth member, e.g., a display unit of the notebook, another object of the hinge device.

Figure 2:
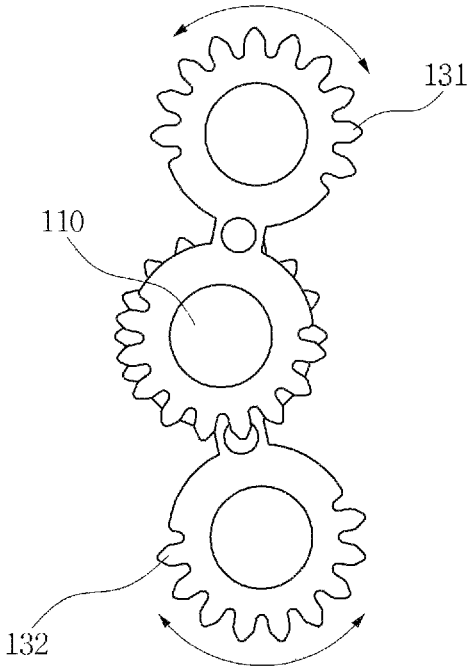
FIG. 2 is a schematic view illustrating movement of a link unit forming a hinge device according to the present invention.

As illustrated in FIG. 2 in which the movement of the link unit (130) forming the hinge device of the present invention, each link unit (130) may be freely rotated without mutual interference using the shaft unit (110) as a rotation shaft. Thus, the degree of rotational freedom between the first member (210) and the second member (220) connected to the fastening unit (150) is also widely provided. However, the degree of rotational freedom of each link unit (130) may be adequately regulated according to usage of the first member (210) and the second member (220). For example, the degree of rotational freedom ($\theta_x$) between the first member (210) and the second member (220) that may be expressed as a sum of degrees of rotational freedom of each link unit (130) may be restricted to 150° for business policy. In order to satisfy this, there is a need of regulating the degree of rotational freedom of each link unit (130) that rotates about a particular shaft unit as a rotation shaft, and to this end, the hinge device may include a guide unit (170).

Figure 3:
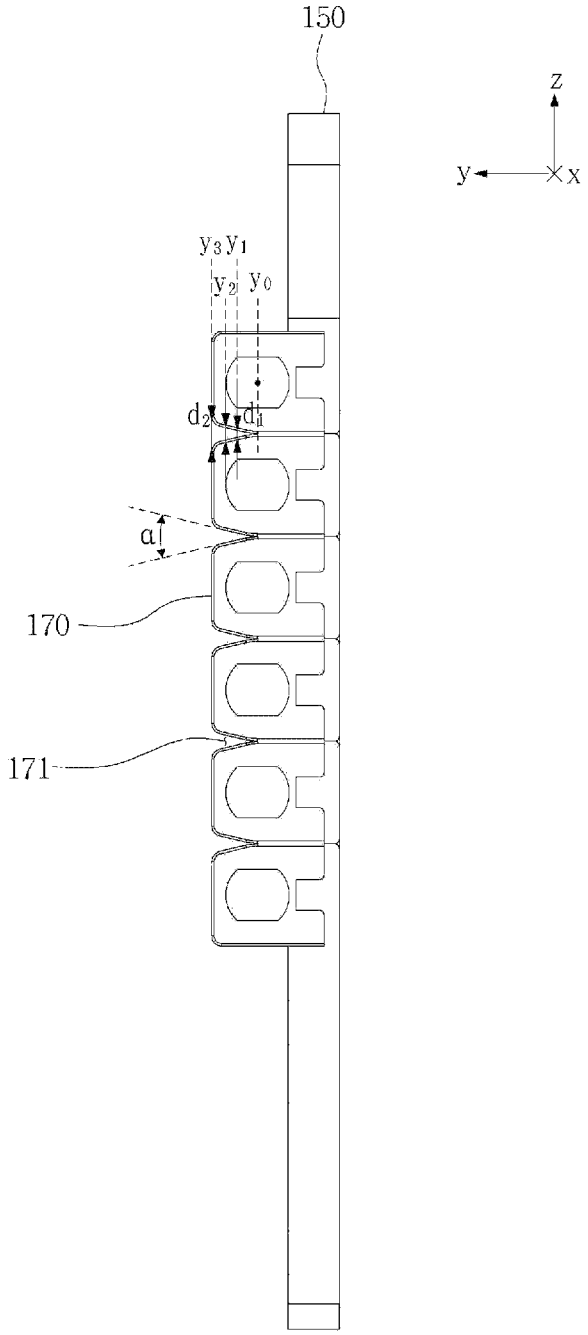
FIG. 3 is a lateral view illustrating a guide unit forming a hinge device according to the present invention.
Figure 4:
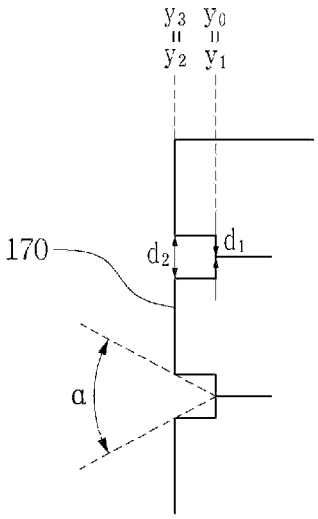
FIG. 4 is a lateral view illustrating another guide unit forming a hinge device according to the present invention.

FIG. 3 is a lateral view illustrating a guide unit (170) forming a hinge device according to the present invention, and FIG. 4 is a lateral view illustrating another guide unit (170) forming a hinge device according to the present invention.

The guide unit (170) may be mounted at each shaft unit (110) and rotated along with each of the shaft units. At this time, a distance between opposite guide units (170) is configured such that a distance ($d_2$) of second area ($y_2$) may be farther than a distance ($d_1$) of first area ($y_1$) on a vertical direction to the first direction and the second direction. At this time, a rotational angle ($\alpha$) between two adjacent guide units (170) is determined by a difference between each distance ($d_1$, $d_2$). Referring to FIG. 3, a total of six guide units (170) are mounted, and five guide units (170) are formed at an area where the guide units (170) face each other. At this time, when a rotational angle ($\alpha$) is set at 30° at the area where the guide units face each other, the degree ($\theta_x$) of rotational freedom between the first member (210) and the second member (220) may be 150° (=30°)×5°).

The most important area in the first area ($y_1$) that determines the rotational angle ($\alpha$) is $y_0$, which is an area of rotation shaft based on y axis, and the most important area in the second area ($y_2$) is $y_3$, which is a corner area of each guide unit (170). A facing area of each guide unit (170), when viewed from x axis direction, may be formation of a first groove (171) extended to the first direction by combining two guide units (170). At this time, a cross-sectional shape of the first groove (171) may be variably changed within a scope that satisfies a condition of "$y_0=y_1$, $y_2=y_3$". For example, a cross-section of the first groove (171) in FIG. 3 may be formed in a shape of tracing the rotational angle ($\alpha$), and a cross-section of the first groove (171) in FIG. 4 may be formed in a shape of a square.

The first groove (171) thus described may be viewed as being formed with a so-called undercut at the corner area of each guide unit.

Figure 10:
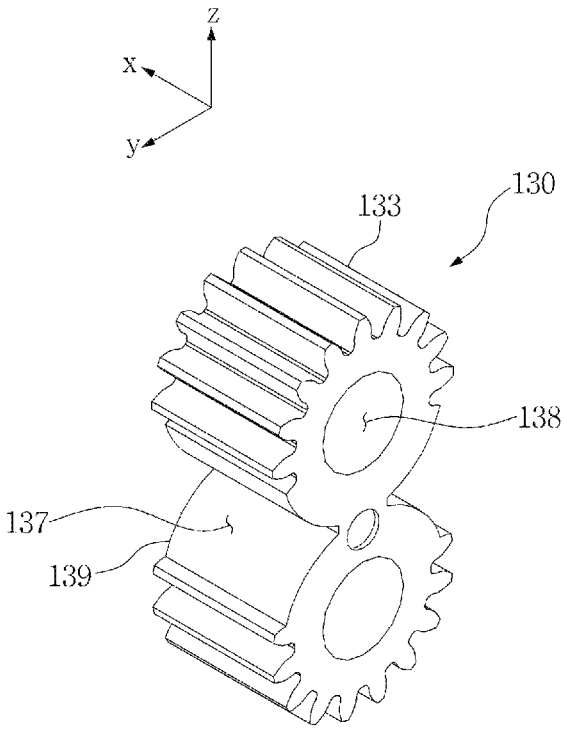
FIG. 10 is a schematic view illustrating a link unit forming a hinge device according to the present invention.

FIG. 10 is a schematic view illustrating a link unit (130) forming a hinge device according to the present invention.

The link unit (130) illustrated in FIG. 10 may include a body unit (139) formed with a through hole (138) inserted by the shaft unit (110) extended to a first direction. At this time, the through hole (138) may be formed in a plural number along a second direction.

The first direction on FIG. 10 is x axis, and the second direction is z axis. According to the link unit (130) thus described, the shaft unit (110) extended to the x axis direction is arranged in parallel to the z axis direction, and when the link unit (130) is arranged to the second direction, the plurality of shaft units (110) may be arranged in parallel.

A distal end of the body unit (139) toward the second direction may be formed with a gear unit (133). When the link unit (130) is arranged to the second direction in a plural number, the gear units (133) of each link unit (130) may be meshed together.

Meanwhile, a second groove (137) extended to the first direction in the body unit (139) may be formed between each through hole (138). The second groove (137) may be formed on a surface facing a 'xz' planar surface. The link unit (130) or the hinge device thus discussed in the foregoing may be covered with a cover in order to prevent safety accidents and to provide an elegant external look. The cover is preferably provided with a flexible and adequate strength, because the cover can move along with the hinge device. Although the thickness of the cover may be thick to provide an adequate strength, the cover is preferred to be thin if possible. To this end, the second groove (137) may be utilized. When an overall thickness of the cover is made to be thin, there is a possibility of the cover being damaged, but when a partial section of the cover is made to be thick, a reliable strength may be provided. At this time, the partial section where the cover is made thick may correspond to the second groove (137) formed at the link unit (130).

Although the present invention has been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of subject combination arrangement within the scope of the disclosure, the drawings and the appended claims. In addition to variations and modifications in the component parts and/or arrangements, alternative uses will also be apparent to those skilled in the art.

DESCRIPTION OF REFERENCE NUMERALS

| | |
|---|---|
| 100 hinge device | 110 shaft unit |
| 130 link unit | 131 first link unit |
| 132 second link unit | 133 gear unit |
| 137 second groove | 138 through hole |
| 139 body unit | 150 fastening unit |
| 170 guide unit | 171 first groove |
| 191 support | 193 elastic unit |
| 195 pressure unit | 197 extension unit |
| 210 first member | 220 second member |

The invention claimed is:

1. A hinge device comprising:

a plurality of shaft units arranged in parallel and extending in a first direction;

a plurality of link units configured to radially surround each shaft unit, connect each shaft unit, and rotate about each shaft unit; and a plurality of guide units disposed on the shaft units and configured to rotate along with each shaft unit, wherein a groove is formed between adjacent guide units among the plurality of guide units, wherein a rotational angle between the adjacent guide units is determined by a shape of the groove, wherein at least one of the plurality of shaft units is mounted with:

a first link unit at a first position along the first direction;

a second link unit at a second position along the first direction;

a support at a third position along the first direction;

a pressure unit at a fourth position along the first direction and configured to apply a pressure to the first link unit and the second link unit in the first direction; and a Belleville spring at a fifth position along the first direction.

2. The hinge device of claim 1, wherein:

the adjacent guide units comprise a first guide unit and a second guide unit;

the groove is formed by a first surface of the first guide unit and a second surface of the second guide unit; and the first and second surfaces are not parallel.

3. The hinge device of claim 1, wherein a width of the groove is tapered in a direction perpendicular to the first direction.

4. The hinge device of claim 1, wherein the groove extends along the first direction.

5. The hinge device of claim 1, wherein a cross section of the groove is formed in a V-shape.

6. The hinge device of claim 1, wherein a total mounting number of the guide units is N, a total number of areas where pairs of adjacent guide units face each is N−1, and N is a positive integer.

7. The hinge device of claim 1, wherein:

each shaft unit is radially surrounded by at least two link units located at different positions along the first direction; and each link unit radially surrounds at least two shaft units.

8. The hinge device of claim 1, wherein a distal end of the first link unit comprises a gear unit meshed with an adjacent second link unit, and a distal end of the second link unit comprises a gear unit meshed with the first link unit.

* * * * *